United States Patent [19]

Weniger

[11] 4,084,144

[45] Apr. 11, 1978

[54] HIGH VOLTAGE WINDING COMPRISING SEVERAL COMPONENT COILS FOR VOLTAGE TRANSFORMERS

[75] Inventor: Manfred Weniger, Brunswick, Germany

[73] Assignee: Siemens Aktiengesellschaft, Munich, Germany

[21] Appl. No.: 805,475

[22] Filed: Jun. 10, 1977

[30] Foreign Application Priority Data

Jun. 24, 1976 Germany ..... 2628524

[51] Int. Cl.[2] ..... H01F 15/14

[52] U.S. Cl. ..... 336/70; 336/84 C; 336/231

[58] Field of Search ..... 336/69, 70, 84 C, 84 R, 336/208, 231

[56] References Cited

U.S. PATENT DOCUMENTS

| | | | |
|---|---|---|---|
| 1,940,840 | 12/1933 | Bellaschi | 336/231 X |
| 2,438,985 | 4/1948 | Ambrose | 336/231 X |

*Primary Examiner*—Thomas J. Kozma

*Attorney, Agent, or Firm*—Kenyon & Kenyon, Reilly, Carr & Chapin

[57] ABSTRACT

A high-voltage winding for use with voltage transformers wherein the winding is provided with a plurality of component coils of decreasing diameter arranged one after the other along an axial direction and with a number of connecting elements for connecting adjacent ones of the aforesaid coils, each of which connecting elements comprises a cylindrical member having a first portion which surrounds the one of its associated adjacent coils having the smaller diameter and a second portion for supporting the one of its associated adjacent coils having the larger diameter.

10 Claims, 4 Drawing Figures

HIGH VOLTAGE WINDING COMPRISING SEVERAL COMPONENT COILS FOR VOLTAGE TRANSFORMERS

BACKGROUND OF THE INVENTION

1. Field of the Invention

The invention relates to a high-voltage winding for voltage transformers and, in particular, to a high-voltage winding equipped with several component coils of decreasing diameter which are connected in series and arranged one after the other along an axial direction and with a number of connecting elements each for connecting together respective adjacently arranged component coils.

2. Description of the Prior Art

In one known high-voltage winding of the above type, the connecting elements are formed by connecting bridges distributed around the circumferences of the component coils. In this winding, the component coils are, preferably, impregnated with an impregnating resin, and the connecting bridges are formed by the impregnating resin in the same operation. Moreover, in this winding, electrical connections for connecting respective adjacent component coils are disposed within the interiors of the connecting bridges.

It is an object of the present invention to provide a high-voltage winding of the above type which can be manufactured at a lower cost than presently known high-voltage windings.

SUMMARY OF THE INVENTION

In accordance with the principles of the present invention, the above and other objectives are accomplished in a winding of the above type by forming each of the connecting elements of the winding as a metallic or metallized plastic cylindrical member provided with a slot for preventing the formation of a short-circuited turn and having a first portion which surrounds the one of its respective adjacent coils having the smaller diameter and a second portion which supports the one of its respective adjacent component coils having the larger diameter.

With the high-voltage winding of the invention configured as aforesaid, shielding rings which have heretofore been provided on the component coils at their outer and inner circumferences in order to obtain a uniform voltage distribution are no longer needed, as their function is now assumed by the cylindrical members. The aforesaid members, therefore, serve not only as mechanical connecting elements for the component coils, but also form at the same time capacitors, by means of which a uniform voltage distribution and a favorable resonance behavior of the winding can be achieved. In addition, these members can act, with appropriate design, to control the field in order to avoid regions of high electric field strength. Moreover, the lack of need for the use of separate shielding rings permits the winding of the invention to be produced at lesser cost than conventional windings requiring such shielding rings.

It is further advantageous in the high-voltage winding of the invention to metallically connect the coil ends of each adjacent pair of coils to the cylindrical member associated with such coils. In this manner, separate connecting lines need not be provided between adjacent pairs of component coils to connect the component coils electrically in series, as the respective cylindrical member associated with the coils is now also utilized for this purpose. As a result, a further reduction in the manufacturing cost of the winding is realized.

Each of the cylindrical members of the high-voltage winding of the invention can be configured as right circular cylinder, if the adjacent component coils associated with the cylindrical coils are such that the outer diameter of the component coil of smaller diameter is at most as large as the inner diameter of the component coil of larger diameter. In general, however, for the purpose of obtaining a low stray impedance and favorable utilization of the electric strength of the insulating gas, the outer diameter of each component coil of smaller diameter will be larger than the inner diameter of its adjacent component coil of larger diameter. In such case, each cylindrical member will generally be flared out along its first portion surrounding a component coil.

The component coils of the high-voltage winding of the invention can be constructed in a number of different ways. Thus, if the second portion of each of the cylindrical members is to be used as a coil form, each component coil can be wound on the second portion of its respective cylindrical member, while the first portion of the member surrounds the respective adjacent component coil of smaller diameter, when the individual component coils are assembled together to form the winding. In this case, the cylindrical members also function as a coil forms, so that the manufacturing costs are further reduced, due to the even farther-reaching multiple utilization of the members.

However, advantageously, the component coils of the high-voltage winding of the invention may also each be formed as a separate structural part or unit. In such case, the first portions of the cylindrical members can be fastened to their respective component coils by clamp connections and the second portions of the members can be pressed against the interiors of their respective component coils by expansion connections. Separate formation of the component coils may be advantageous particularly for manufacturing reasons.

More particularly, formation of a component coil as a separate structural unit can be realized in an advantageous manner by winding with each wire turn of circular wire, strips of insulating material in the form of a plastic foil with a width corresponding to the width of the component coil, where the thickness of the plastic foil is made such, in view of the diameter of the circular wire, that the ratio of diameter to thickness is more than 50. Such a component coil can be manufactured relatively easily, as the circular wire can be wound continuously together with the plastic foil. It is a further advantage of a component coil formed in the aforesaid manner that the plastic foil surrounds the individual turns of wire with a tight fit, so that there is no danger that the outermost turns of wire might slip out of the component coil.

Particularly in cases where the component coils are to be formed as separate or self-supporting units, it is advantageous to subject each component coil to a heat treatment. The shrinkage forces on the plastic foil generated by such treatment thus result in the formation of a compact, self-supporting coil.

To achieve a linear capacity distribution over the high-voltage winding of the invention, it is further advantageous to configure the component coils such that the coils of increased diameter have a decreased width. However, to realize the simplest possible fabrication of the winding of the invention, it appears more advantageous to employ component coils of equal winding cross section and to further provide the winding with an electrode which is supported by the component coil with the largest diameter and which is tapered downwardly toward or is flared outwardly from the component coil with the smallest diameter. Equal capacities are then obtained by shaping only this one electrode accordingly, while the individual component coils have the same winding cross section.

For manufacturing reasons, it may also be advantageous in some cases to again use component coils with equal winding cross section but to choose the axial length of the cylindrical members so that members whose first portions surround coils of increasing diameter having decreasing axial lengths. In this case, it is also advantageous to provide a cylindrical electrode which extends over almost the entire coil assembly and is supported by the component coil with the largest diameter. Moreover, in order to support the portion of the cylindrical members protruding beyond their respective component coils, simple disk supports which present fields of cylindrical symmetry may be used.

BRIEF DESCRIPTION OF THE DRAWINGS

The above and other features and aspects of the present invention will become more apparent upon reading the following detailed description in conjunction with the accompanying drawings, in which.

DETAILED DESCRIPTION

Figure 1:
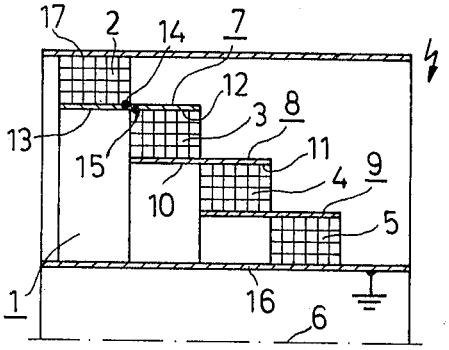
FIGS. 1–4 show cross section views of various embodiments of windings in accordance with the principles of the present invention.

FIG. 1 shows in cross section a high-voltage winding 1 in accordance with the principles of the present invention. The winding 1 comprises the component coils 2, 3, 4 and 5 of decreasing diameter which are arranged one after the other in the direction of the winding axis 6. More particularly, as shown in FIG. 1 in going from left to right along the winding axis 6, the diameters of the coils 2 to 5 are decreased in such a manner that each component coil has an outer diameter which is equal to the inner diameter of the preceding coil.

The aforesaid coils 2 to 5 are connected by right circular cylindrical members 7 to 9. More particularly, each cylindrical member 7 to 9 connects adjacent ones of the component coils 2 to 5 in such a manner that a first portion of each cylindrical member surrounds a coil of smaller diameter and a second portion of that cylindrical member carries or supports the adjacent coil of larger diameter. Thus, for example, the cylindrical member 8 has a first portion 11 which surrounds the component coil 4 and a second portion 10 which supports the larger diameter immediately adjacent component coil 3. Likewise, the cylindrical member 7 has a first portion 12 which surrounds the component coil 3 and a second portion 13 which supports the immediately adjacent larger diameter coil 2.

If the component coils 2 to 5 are to be manufactured as separate structural units or parts, then the cylindrical members 7 to 9 may be fastened to the insides of their respective component coils, for example, through expansion connections. Additionally, the cylindrical members may be connected to the outsides of their respective component coils by clamp connections. The cylinders 7 to 9, thus serve as connecting elements thereby permitting the realization of a self-supporting coil assembly.

To avoid the need to employ connecting leads between the component coils, the ends of adjacent coils can be metallically connected to the cylindrical member associated with such coils. Thus, as shown, the coils 2 and 3 are connected at the points 14 and 15 to their associated cylindrical member 7. In this manner, the component coils can be connected in series via the cylindrical members 7 to 9.

The component coil 5, which has the smallest diameter, is mounted on an additional cylindrical member 16, which is tied to ground potential. The component coil 2, which has the largest diameter supports an electrode 17 which extends over almost the entire axial length of the winding. In cooperation with the cylindrical members 7 to 9, the electrode 17 ensures that there is a largely uniform capacity distribution and, as a result, also a largely uniform surge voltage distribution over the length of the winding.

Figure 2:
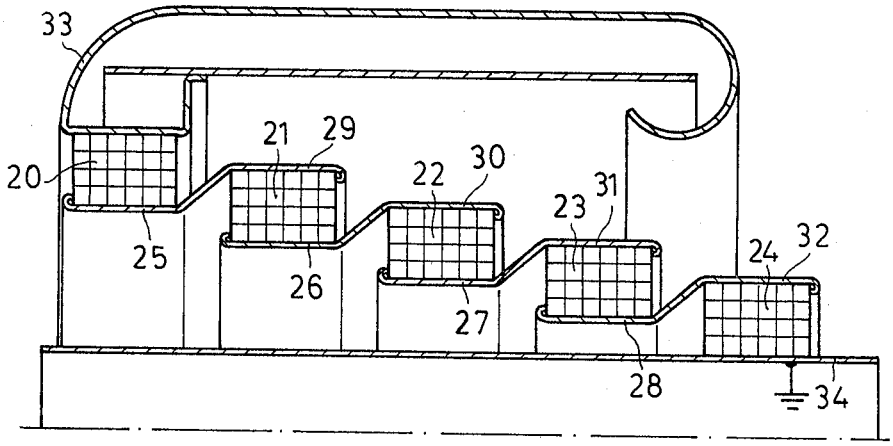

The embodiment of the high-voltage winding of the invention shown in cross section in FIG. 2 also comprises several component coils of decreasing diameter 20, 21, 22, 23 and 24 which are mechanically connected to each other via cylindrical members 25, 26, 27 and 28. As the component coils 20 to 24 are not arranged so that the outer diameter surface of each coil is aligned with the inner diameter surface of the preceding coil of larger diameter, the first portions 29, 30, 31 and 32 of the cylindrical members are concially flared so as to be albe to surround, respectively, the component coils 21 to 24. In this embodiment the cylindrical members can also be fastened to the inner and outer diameter surfaces of their respective component coils by expansion and clamp connections, respectively. Also, in this case, cylindrical members 25 to 28 are utilized to electrically connect the individual component coils to each other, as the ends of the adjacent component coils associated with each cylindrical member are metallically connected to that member.

To obtain a capacity distribution as uniform as possible over the high-voltage winding, the component coil 20 of largest diameter supports a cylindrical electrode 33. If the winding is to be used in connection with a cascade transformer, a secondary or overcoupling winding can be arranged within the electrode 33. The component coil 24 with the smallest diameter is arranged on a further electrode 34, which is grounded.

Figure 3:
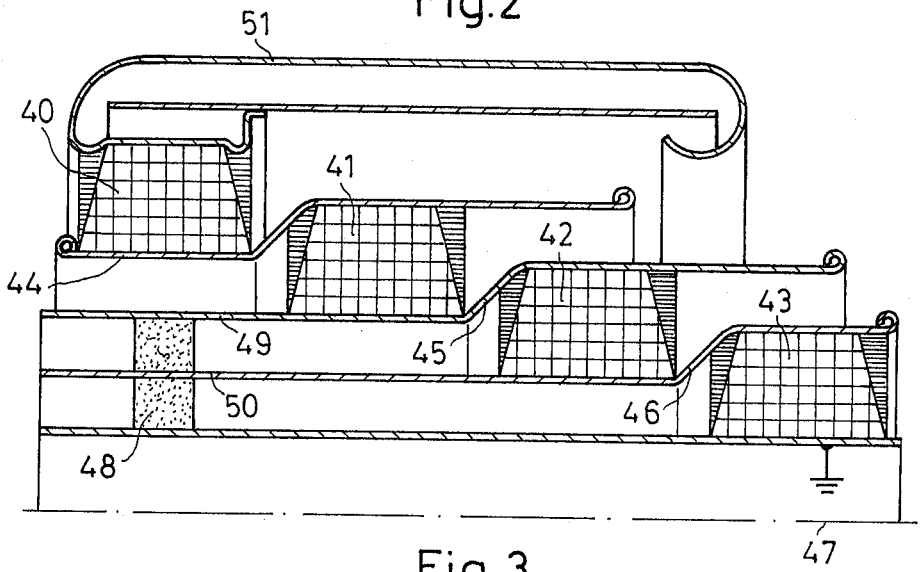

In the embodiment of the invention shown in FIG. 3, the individual component coils of the high-voltage winding are formed as trapezoidal coils 40, 41, 42 and 43. These coils are connected to each other mechanically and electrically by slotted cylindrical members 44, 45 and 46, the cylindrical members being arranged in a similar manner as already discussed in the embodiments of FIGS. 1 and 2. In order to obtain a particularly uniform capacity distribution, and, therefore, surge voltage distribution, the axial length of the cylindrical members 44 to 46 is reduced in going from cylindrical members surrounding coils of smaller diameter to cylindrical members surrounding coils of larger diameter. Thus, the cylindrical member 46 surrounding the coil of smallest diameter has the longest axial length and the cylindrical member 44 surrounding the coil of largest diameter has the shortest axial length. The cylindrical members 45 and 46 are supported by disk supports 48, shown only schematically, along portions 49 and 50 thereof which extend beyond the component coils, 41 and 42. In this embodiment, the cylindrical members 44 to 46 in conjunction with a cylindrical electrode 51 supported by the component coil 40 of the largest diameter, ensure that there is a particularly good equalization of the capacity and surge voltage distribution.

Figure 4:
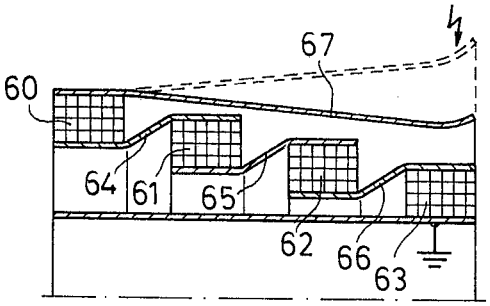

Another arrangement for obtaining particularly advantageous uniform capacity and surge voltage distributions is shown in the embodiment of the invention illustrated in FIG. 4. In this arrangement, the component coils 60, 61, 62 and 63 are connected to each other mechanically and electrically via the cylindrical members 64 to 66 in the same manner as in the embodiment of FIG. 2, but provision is further made for an electrode 67. The latter is supported by the component coil 60 of largest diameter and can be flared outwardly from or tapered downwardly toward the component coil 63 of smallest diameter, in order to obtain a uniform voltage distribution.

What is claimed is:

1. A high-voltage winding for voltage transformers comprising:

a plurality of component coils of decreasing diameter arranged one after the other along an axial direction;

a number of connecting elements each connecting adjacent ones of said component coils to thereby form a self-supporting unit, each of said connecting elements comprising a conductive cylindrical member having a first portion which surrounds the one of its associated adjacent coils having the smaller diameter and a second portion which supports the one of its associated adjacent coils having the larger diameter, said cylindrical member having a slot for preventing the formation of a short-circuited turn.

2. A winding in accordance with claim 1 wherein:

each of said cylindrical members comprises a metal.

3. A winding in accordance with claim 1 wherein:

each of said cylindrical members comprises a metallized insulating material.

4. A winding in accordance with claim 1 wherein:

each adjacent pair of coils associated with a given cylindrical member having their coil ends metallically connected to that cylinder.

5. A winding in accordance with claim 1 wherein the first portion of each of said cylindrical members is flared out conically.

6. A winding in accordance with claim 1 wherein:

the second portions of said cylindrical members serve as coil forms for the respective component coils which they support.

7. A winding in accordance with claim 1 wherein:

each of said coils is a separate structural member;

and said winding further comprises for each of said cylindrical members a clamp means for fastening the first portion of that member to the coil surrounded by that first portion, and an expansion connection for pressing the second portion of that member to the coil supported by that second portion.

8. A winding in accordance with claim 1 wherein:

each of said coils has an equal winding cross section;

and said winding further includes an electrode supported by the coil of largest diameter, said electrode being one of flared outwardly from and tapered downwardly toward the component coil of smallest diameter.

9. A winding in accordance with claim 1 wherein:

the component coils have equal winding cross sections;

the axial length of said cylindrical members decreases for members having first portions surrounding coils of increasing diameter;

and said winding further includes a cylindrical electrode supported by the coil of largest diameter and extending over substantially the entire winding.

10. A winding in accordance with claim 9 wherein:

a number of said cylindrical members have a further portion extending beyond their respective first portions in a direction away from their respective second portions;

and said winding further includes disk supports for supporting said further portions of said cylindrical members.

* * * * *